US010989012B2

(12) United States Patent
Hrabovsky

(10) Patent No.: US 10,989,012 B2
(45) Date of Patent: Apr. 27, 2021

(54) BYPASS ADAPTER FOR USE WITH A PACKER TOOL ON A PRODUCTION TUBING POSITIONED IN A CASING STRING

(71) Applicant: James Hrabovsky, Victoria, TX (US)

(72) Inventor: James Hrabovsky, Victoria, TX (US)

( * ) Notice: Subject to any disclaimer, the term of this patent is extended or adjusted under 35 U.S.C. 154(b) by 0 days.

(21) Appl. No.: 16/906,737

(22) Filed: Jun. 19, 2020

(65) Prior Publication Data

US 2020/0399975 A1 Dec. 24, 2020

Related U.S. Application Data

(60) Provisional application No. 62/863,445, filed on Jun. 19, 2019.

(51) Int. Cl.
*E21B 33/12* (2006.01)
*E21B 34/06* (2006.01)
*E21B 43/12* (2006.01)

(52) U.S. Cl.
CPC ..... *E21B 33/12* (2013.01); *E21B 34/06* (2013.01); *E21B 43/123* (2013.01)

(58) Field of Classification Search
CPC ..... E21B 33/122; E21B 34/06; E21B 34/08; E21B 34/10; E21B 34/16; E21B 43/123
USPC ..... 166/129
See application file for complete search history.

(56) References Cited

U.S. PATENT DOCUMENTS 5,022,427 A * 6/1991 Churchman ..... E21B 43/123 137/155

* cited by examiner

*Primary Examiner* — Robert E Fuller
*Assistant Examiner* — Lamia Quaim
(74) *Attorney, Agent, or Firm* — Jonathan Pierce; Pierre Campanac; Porter Hedges LLP

(57) ABSTRACT

On a production tubing positioned in a casing string, a bypass adapter is coupled to a packer tool. The bypass adapter comprises an inner mandrel positioned in an inner bore of the packer tool. Injection gas flows between the production tubing and the casing string, through a plurality of ports, in a space located inside the inner bore of the packer tool and outside of the inner mandrel, thus bypassing the packer tool. This injection gas then flows down the outside of a tailpipe located below the packer tool. Fluid produced by the well mixed with this injected gas flows inside the tailpipe, through the inner mandrel, and into the production tubing.

15 Claims, 5 Drawing Sheets

BYPASS ADAPTER FOR USE WITH A PACKER TOOL ON A PRODUCTION TUBING POSITIONED IN A CASING STRING

CROSS-REFERENCE TO RELATED APPLICATIONS

This application claims the benefit of priority to U.S. provisional application Ser. No. 62/863,445 filed on Jun. 19, 2019. The priority application is hereby included by reference for any purposes.

BACKGROUND

This disclosure relates generally to a bypass adapter for use with a packer tool on a production tubing positioned in a casing string.

Most Oil and Gas wells include a string of casing. The casing is cemented in the wellbore, thus making it very expensive to repair if it is affected by erosion or corrosion. In some cases, erosion or corrosion of the casing can even cause the well to be junked. In order to reduce erosion or corrosion, a production tubing and a packer tool are used to isolate the upper part of the casing from corrosive produced fluids or gases, such as H2S or CO2, that are produced by the reservoir. The packer tool has a packer element capable of sealing against the casing string. The packer tool forces all produced fluids inside the inner bore of the packer and up the production tubing and isolates the casing above it from the produced fluids.

Gas Lift is one of the most economical ways to artificially lift an Oil and Gas well once it dies and cannot flow on its own anymore. In Gas Lift Installations, gas is injected down between the production tubing and the casing. The injected gas is pressurized up to a point at which Gas Lift Valves, which have been run at predetermined depths on the production tubing and set at predetermined pressures, open. This gas enters the production tubing through the Gas Lift Valves and starts to aerate the fluid column of the dead well. This aeration lightens the fluid and allows it to, once again, reach the surface. The deeper gas is injected into the fluid column, the lighter the column becomes, therefore reducing the pressure inside the wellbore at the perforations into the reservoir. More fluid is able to enter the wellbore as this pressure is reduced.

Packer tools have been a limiting factor in how deep gas could be injected in a Gas Lift Installation. Originally, Gas Lift Valves have only been able to be run above the packer because the packer isolates the upper part of the casing from the lower part of the casing, preventing the gas injected between the production tubing and the casing from reaching the lower part of the casing. With the onset of Horizontal Drilling, limitations resulting from the packer became a more significant problem because the packer could not be set as close to the perforations as it could in vertical wells. Indeed, at high degrees of deviation, a packer becomes challenging to set and retrieve. Setting the packer in the vertical section of the well and running the Gas Lift Valves above the packer prevents the fluid column in the curved and horizontal sections of the well to be aerated, maintaining the weight of the fluid column in these sections and thus limiting production.

The problem of packers limiting how deep gas could be injected in a Gas Lift Installation was solved with the development of a Bypass Packer. There are a couple of types of By-Pass Packer tools available on the market now. One type uses a "Dip Tube" that extends from above the packer element, down through the mandrel of the packer, and back out into the casing below the packer element. The other type utilizes a "Capillary String" that runs from above the packer element, down through the mandrel and all the way to the end of the tailpipe. With a Bypass Packer, it is possible to inject the gas into the fluid column at the end of the tailpipe.

The problems encountered with these two types of By-Pass Packer tools are many. One problem is that the By-Pass Packer tools usually have one injection port, which often becomes plugged because of its small flow area of 0.077 sq. Inches. Another problem is that the Dip Tube or Capillary String becomes plugged because of the small ID: it has a maximum flow area of 0.196 sq. Inches. Yet another problem is the inability to run tools through the By-Pass Packer because it does not have a smooth inner bore. Instead, the inner bore is encumbered by the Dip Tube or Capillary String.

Thus, there is a continuing need in the art for methods and apparatus for bypass adapters for use with a packer tool on a production tubing positioned in a casing string.

BRIEF SUMMARY OF THE DISCLOSURE

The disclosure describes a bypass adapter for use with a packer tool on a production tubing positioned in a casing string.

The bypass adapter may comprise an outer assembly and an inner assembly coupled to the outer assembly.

The outer assembly may comprise an inlet sub. The inlet sub may include a tubular body coupled to the inner assembly. For example, the tubular body may be threadedly connected to a top sub comprised in the inner assembly. The inlet sub may further include an inner bore, an outer surface, and a plurality of injection ports extending between the inner bore below a coupling to the inner assembly and the outer surface. The inlet sub may be coupled to the packer tool.

The outer assembly may comprise the packer tool. The packer tool may be coupled to the inlet sub. For example, the packer tool may be threadedly connected to the inlet sub. The packer tool may include an inner bore, and a packer element capable of sealing against the casing string.

The outer assembly may comprise a bottom sub. The bottom sub may include a tubular body coupled to the packer tool. For example, the tubular body may be threadedly connected to the packer tool. The bottom sub may further include an inner bore, a seal located in the inner bore, an outer surface, and a plurality of exit ports extending between the inner bore above the seal and the outer surface.

The inner assembly may comprise the top sub. The top sub may include a tubular body connectable to the production tubing.

The inner assembly may comprise an inner mandrel. The inner mandrel may be coupled to the top sub. For example, the inner mandrel may be threadedly connected to the top sub. The inner mandrel may be sized to be positioned in the inner bore of the packer tool. The inner mandrel may further be sized to be positioned in the inner bore of the bottom sub in engagement with the seal of the bottom sub. An inner bore of the inner mandrel may be essentially flush with a lower portion of an inner bore of the top sub whereby downhole tools can be run through the inner bore of the inner mandrel and the inner bore of the top sub.

The bypass adapter may further comprise a plurality of check valves. In some embodiments, each of the plurality of check valves may be capable of controlling the flow of the first fluid through a corresponding one of the plurality of injection ports of the inlet sub. Each of the plurality of check valves may be positioned in a corresponding one of a plurality of pockets. Each of the plurality of pockets may be formed into the top sub. Optionally, a plurality of longitudinal grooves may extend from a corresponding one of the plurality of pockets to a top surface of the top sub. Optionally, a circumferential groove may extend across all of the plurality of pockets. In other embodiments, for example, in large diameter casings, each of the plurality of check valves may be capable of controlling the flow of the first fluid through a corresponding one of the plurality of exit ports of the bottom sub instead of the injection ports of the inlet sub. Each of the plurality of check valves may be positioned in a corresponding one of a plurality of pockets formed into the bottom sub.

A first fluid, typically injection gas, may flow between the production tubing and the casing string, through the plurality of injection ports of the inlet sub, in a space located outside the inner mandrel and inside the packer tool, and through the plurality of exit ports in the bottom sub. Preferably, the space located outside the inner mandrel and inside the packer tool may have an annular cross-section with a flow area at least equal to half of the flow area of the inner mandrel.

A second fluid, typically fluid produced by the well mixed with injected gas, may flow inside the inner mandrel and into the production tubing.

BRIEF DESCRIPTION OF THE DRAWINGS

For a more detailed description of the embodiments of the disclosure, reference will now be made to the accompanying drawings, wherein.

DETAILED DESCRIPTION

Figure 1:
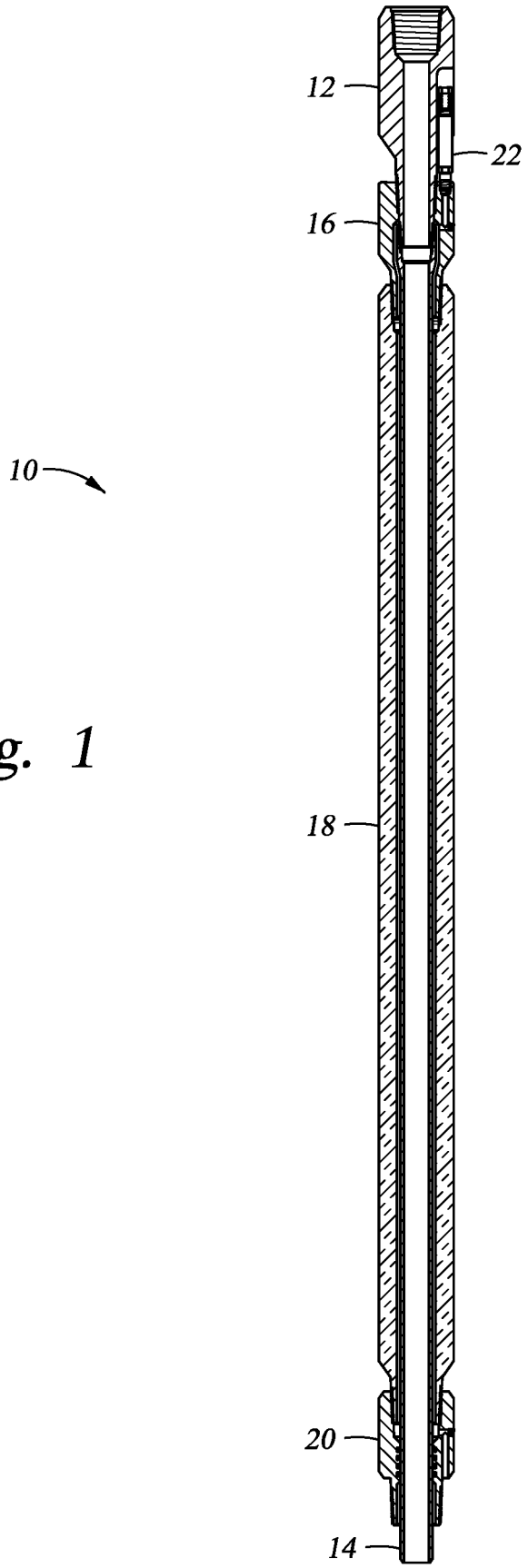
FIG. 1 is a sectional view of a bypass adapter connected to a packer tool.

It is to be understood that the disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Additionally, the exemplary embodiments presented below may be combined in any combination of ways, i.e., any element from one exemplary embodiment may be used in any other exemplary embodiment, without departing from the scope of the disclosure. Finally, all numerical values in this disclosure may be approximate values unless otherwise specifically stated. Accordingly, various embodiments of the disclosure may deviate from the numbers, values, ranges, and proportions disclosed herein or illustrated in the Figures without departing from the intended scope.

The bypass adapter disclosed herein is connected to a packer tool. In an example embodiment, the bypass-adapter comprises an injection sub that includes a plurality of injection ports, for example, three injection ports. Each of these injection ports can be equipped with a check valve to prevent backflow from the packer tool. Each of these injection ports may have a typical flow area of 0.077 sq. Inches, providing the bypass adapter with an effective injection flow area of 0.231 sq. Inches. The plurality of injection ports may permit longer run time of the bypass adapter, even in conditions where scale deposition occurs.

In an example embodiment of the bypass adapter, a first fluid (e.g., a gas injected during Gas Lift) may flow between the production tubing and the casing string, through the plurality of injection ports of the inlet sub, and through a space located outside the inner mandrel and inside the packer tool. The cross-section of the space can have an effective flow area of 1.337 sq. Inches, virtually the same flow area of 1¼ inches tubing.

In an example embodiment of the bypass adapter, an inner bore of the inner mandrel may be essentially flush with a lower portion of an inner bore of the top sub. These inner bore may have an internal diameter of 1.75 inches. The geometry can permit running downhole tools below the packer tool, should it become necessary. A second fluid (e.g., fluid produced by the well mixed with injected gas) may flow inside the inner mandrel and into the production tubing.

Figure 3:
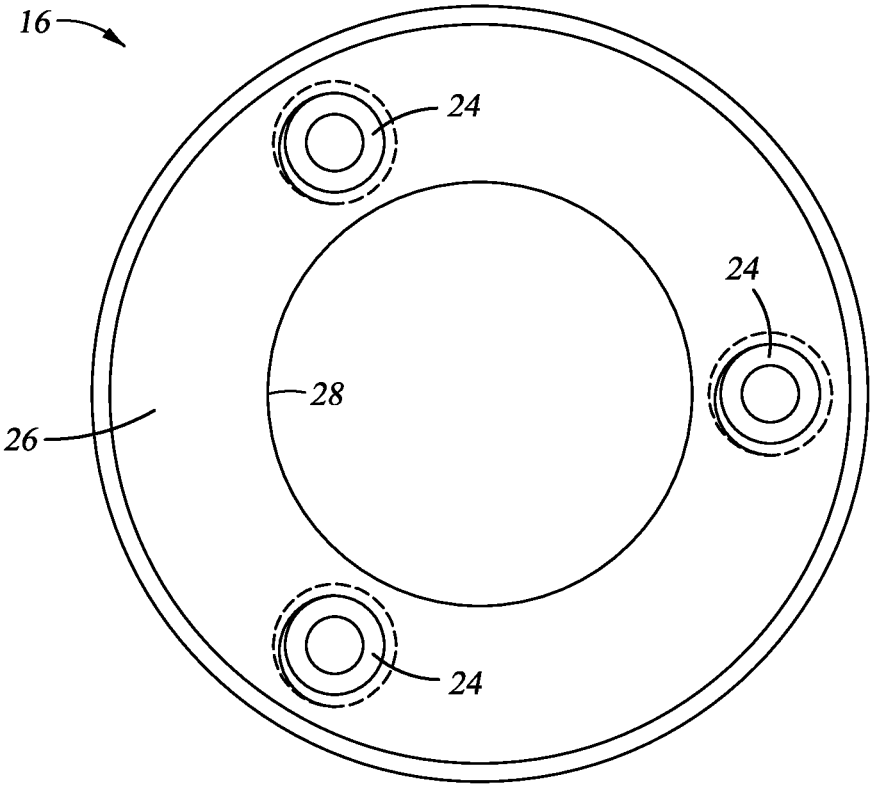
FIG. 3 is a top view of the inlet sub of the bypass adapter shown in FIG. 1.

Referring to FIG. 1, a sectional view of a bypass adapter 10 connected to a packer tool 18 is illustrated. The bypass adapter 10 comprises an inner assembly, which includes a top sub 12 and an inner mandrel 14, and an outer assembly, which includes an inlet sub 16, the packer tool 18, and the bottom sub 20. The inner assembly is coupled to the outer assembly. The bypass adapter 10 further comprises a plurality of check valves 22. Only one check valve 22 is visible in FIG. 1; however, as best seen in FIG. 3, three check valves 22 are equally distributed around a central inner bore of the inlet sub 16.

The plurality of check valves 22 may be connected to the inlet sub 16 via National-Pipe-Thread (NPT) connections. Check valves of different sizes can be connected to the inlet sub 16 by using threaded adapters. Each of the plurality of check valves may be capable of controlling the direction of flow of the first fluid through a corresponding one of the plurality of injection ports of the inlet sub. Fewer or more than three check valves 22 may be connected to the inlet sub 16.

Figure 2:
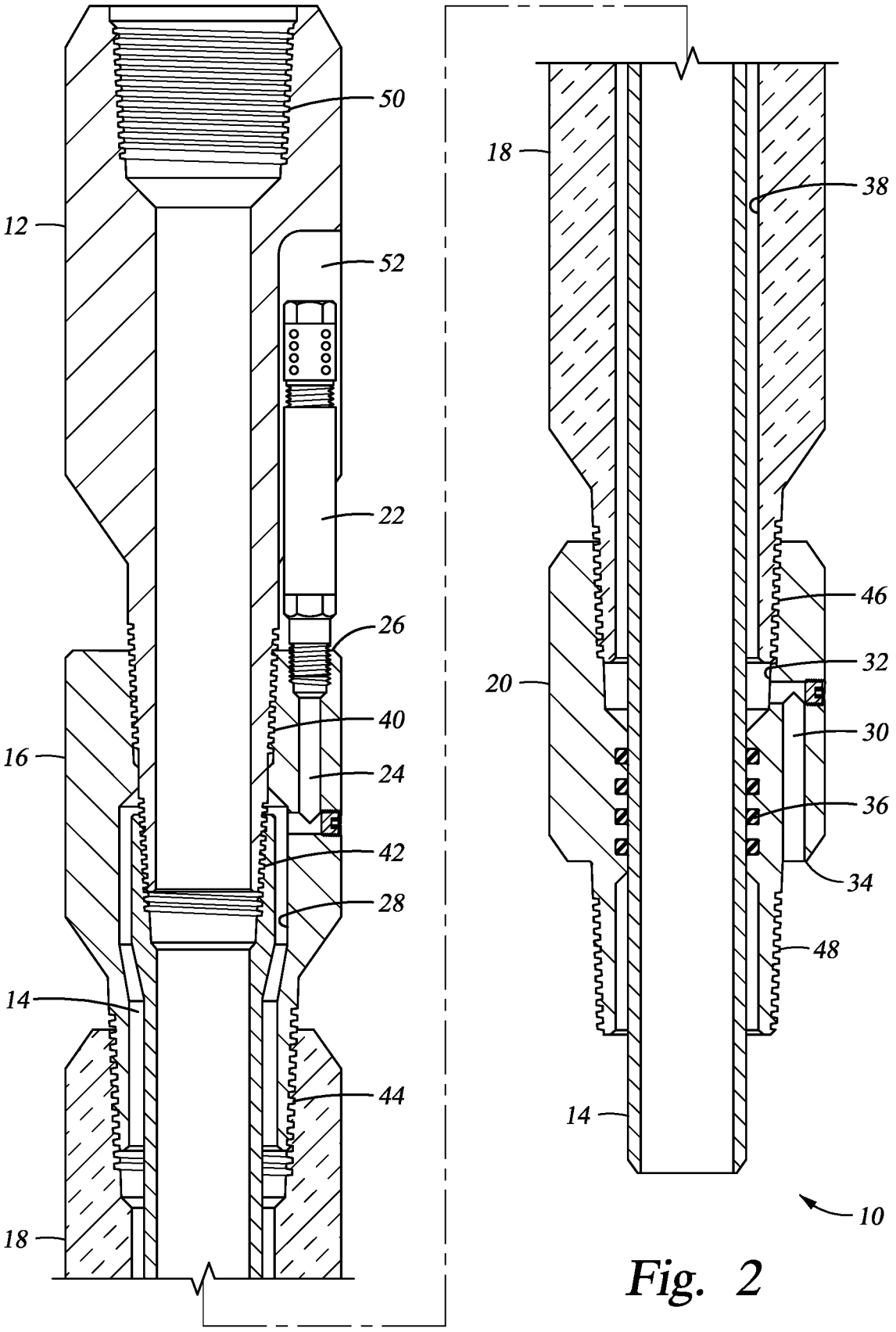
FIG. 2 is a sectional view of portions of the bypass adapter shown in FIG. 1.

Referring to FIG. 2, the top sub 12 includes a tubular body. The tubular body is connectable to the production tubing via a box end 50 of an External-Upset-End (EUE) tubing connection. Each of the plurality of check valves 22 is positioned in a corresponding one of a plurality of pockets 52. Each of the plurality of pockets 52 is formed into the top sub 12. The inner mandrel 14 is coupled to the top sub 12 via an Integral-Joint (IJ) tubing connection 42. The inlet sub 16 includes a tubular body. The tubular body is coupled to the top sub 12 via a Non-Upset (NU) tubing connection 40. The packer tool 18 is coupled to the inlet sub 16 via a EUE tubing connection 44. The bottom sub 20 includes a tubular body. The tubular body is coupled to the packer tool 18 via a EUE tubing connection 46. The tubular body is also connectable to a tailpipe (not shown) via a pin end 48 of a EUE tubing connection. The couplings between the parts have been described with preferred threaded connection types; however, in other embodiments, other types of threaded connections may be used instead. Also, in other embodiments, other types of coupling may be used instead. For example, some of the parts of the inner assembly and/or outer assembly may be joined and be made unitary. Further, some of the parts, while illustrated as unitary, may be made of several parts coupled together.

The inlet sub 16 includes an inner bore 28. A plurality of injection ports 24 extend between the inner bore 28 below the NU tubing connection 40 and an outer surface 26 (e.g., a top surface) of the inlet sub 16. Only one injection port 24 is visible in FIG. 1; however, as best seen in FIG. 3, three injection ports 24 are equally distributed around the inner bore 28 of the inlet sub 16. While three injection ports 24 are illustrated, in other embodiments, more of fewer injection ports may be used. Each of the plurality of check valves 22 is capable of controlling the flow of fluid through a corresponding one of the plurality of injection ports 24 of the inlet sub 16. The packer tool 18 includes an inner bore 38. The bottom sub 20 includes an inner bore 32. A plurality of exit ports 30 extend between the inner bore 32 above a seal 36 (e.g., one or more O-rings) and an outer surface 34 (e.g., a side surface) of the bottom sub 20. Only one exit port 30 is visible in FIG. 1; however, three exit ports 30 are equally distributed around the inner bore 32 of the bottom sub 20, in a way similar to the injection ports 24 shown in FIG. 3. While three exit ports 30 are illustrated, in other embodiments, more of fewer exit ports may be used. The injection ports 24, the inner bore 28 of the inlet sub 16, the inner bore 38 of the packer tool 18, the inner bore 32 of the bottom sub 20, and the exit ports 30 are fluidly connected such that a first fluid flowing between the production tubing and the casing string can enter the injection ports 24 through the check valves 22 and leave the exit ports 30, thus bypassing a packer element capable of sealing against the casing string provided on the packer tool 18.

In alternative embodiments, for example, in casings having an internal diameter larger than 5.5 inches, the plurality of check valves 22 may alternatively be connected to the exit ports 30 below the bottom sub 20. Regardless of whether the check valves 22 are connected to the injection ports 24 or the exit ports 30, the check valves 22 are configured to allow flow only in the downward direction.

The inner mandrel 14 is sized to be positioned in the inner bore 38 of the packer tool 18. The inner mandrel 14 is further sized to be positioned in the inner bore 32 of the bottom sub 20, and in engagement with the seal 36 of the bottom sub 20. An inner bore of the inner mandrel 14 is fluidly connected to an inner bore of the top sub 12 such that a second fluid entering a bottom of the inner mandrel 14 can flow and leave a top of the adapter sub 12, thus reaching the production tubing connected on top of the adapter sub 12.

In contrast to other known bypass adapters, the inner bore of the inner mandrel 14 is essentially flush with a lower portion of the inner bore of the top sub 12 such that downhole tools can be run through the inner bore of the inner mandrel 14 and the inner bore of the top sub 12. Furthermore, a space located outside the inner mandrel 14 and inside the inner bore 38 of the packer tool 18 has an annular cross-section. The cross-section preferably has a flow area at least equal to half of the flow area of the inner mandrel 14.

Figure 4:
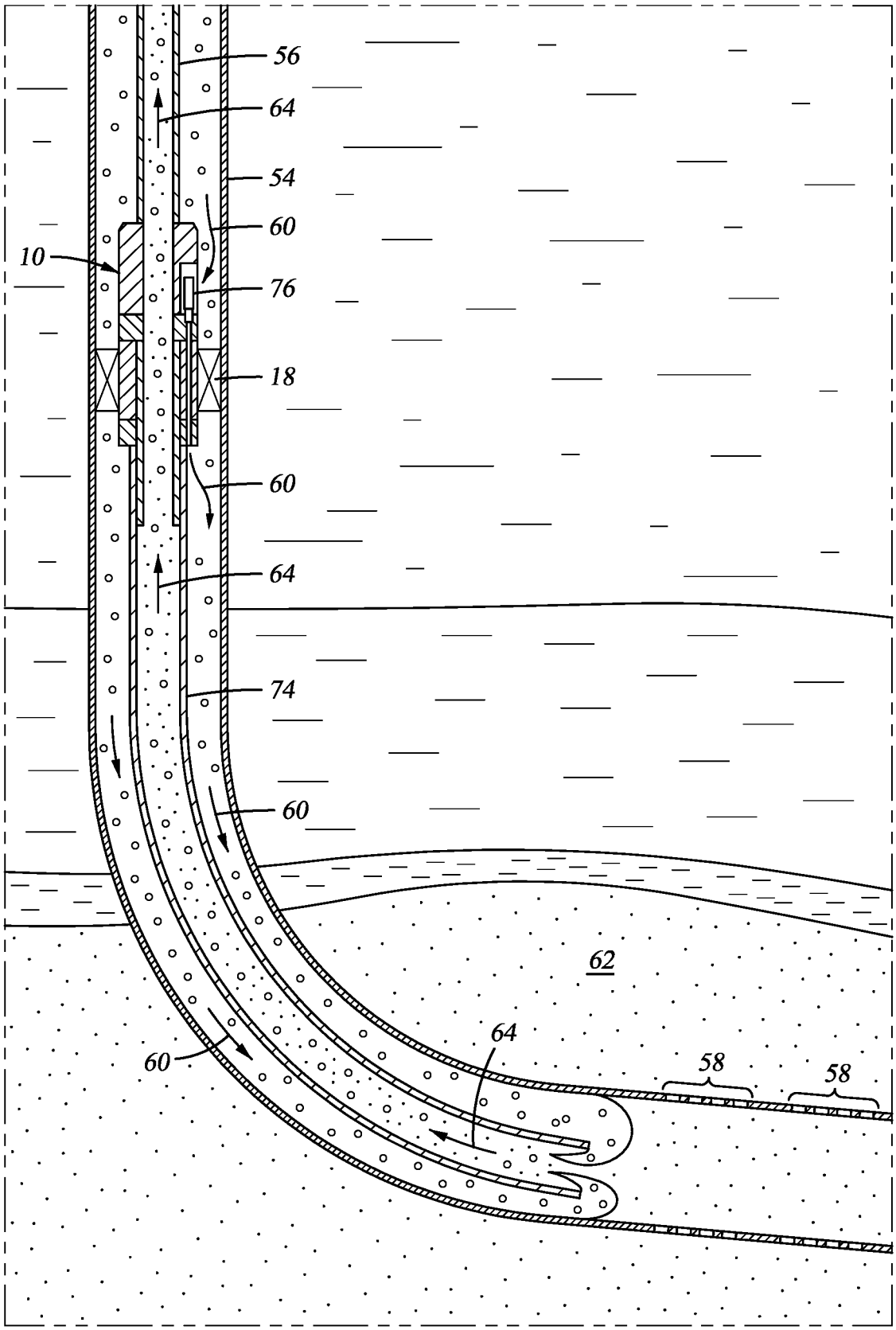
FIG. 4 is a schematic view illustrating the use of the bypass adapter shown in FIG. 1 on a production tubing positioned in a casing string.

Referring to FIG. 4, the use of the bypass adapter 10 on a production tubing 56 positioned in a casing string 54 is illustrated. Injection gas 60 flows between the production tubing 56 and the casing string 54, through the plurality of check valves 22, in the space located inside the inner bore of the packer tool 18, thus bypassing the packer tool 18. The injection gas then flows down the outside of a tailpipe 74 located below the packer tool. The opening pressure of the Gas Lift Valve 76 directly above the packer tool 18 determines the length of the tailpipe 74. Fluid produced by the reservoir 62 at perforations 58 is mixed with the injection gas 60. The resulting mixture 64 is lighter than the fluid produced by the reservoir 62. The mixture 64 flows inside the production tubing 56, through the bypass adapter 10 toward the Earth's surface.

Figure 5A:
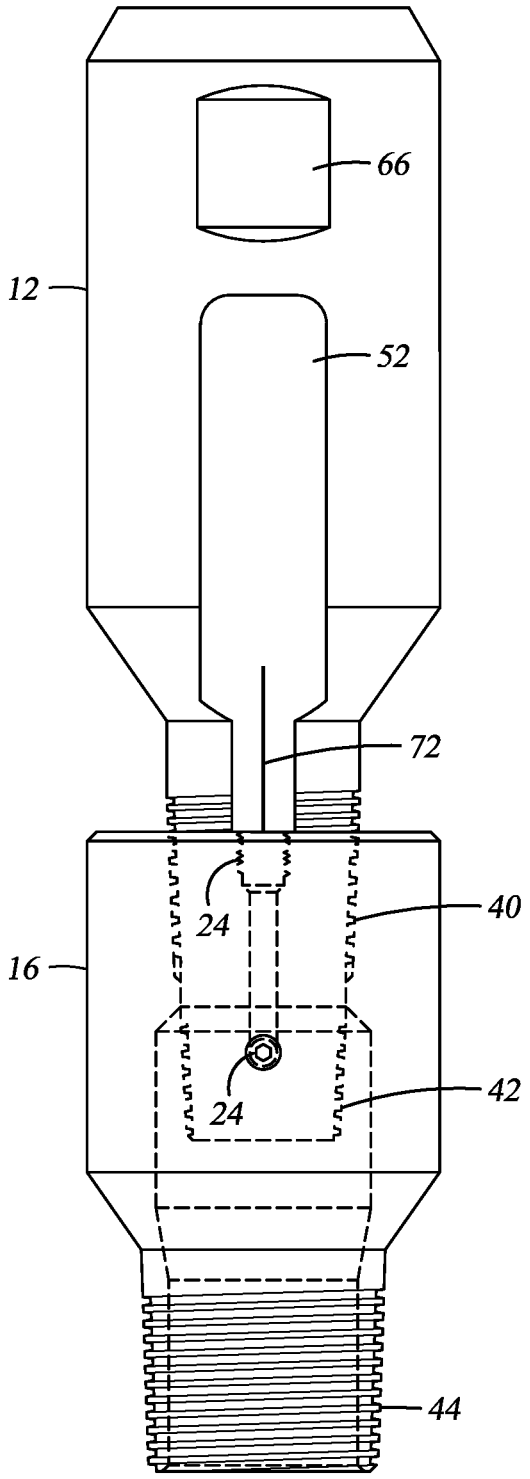
FIG. 5A is a side view of a top sub and an inlet sub.
Figure 5B:
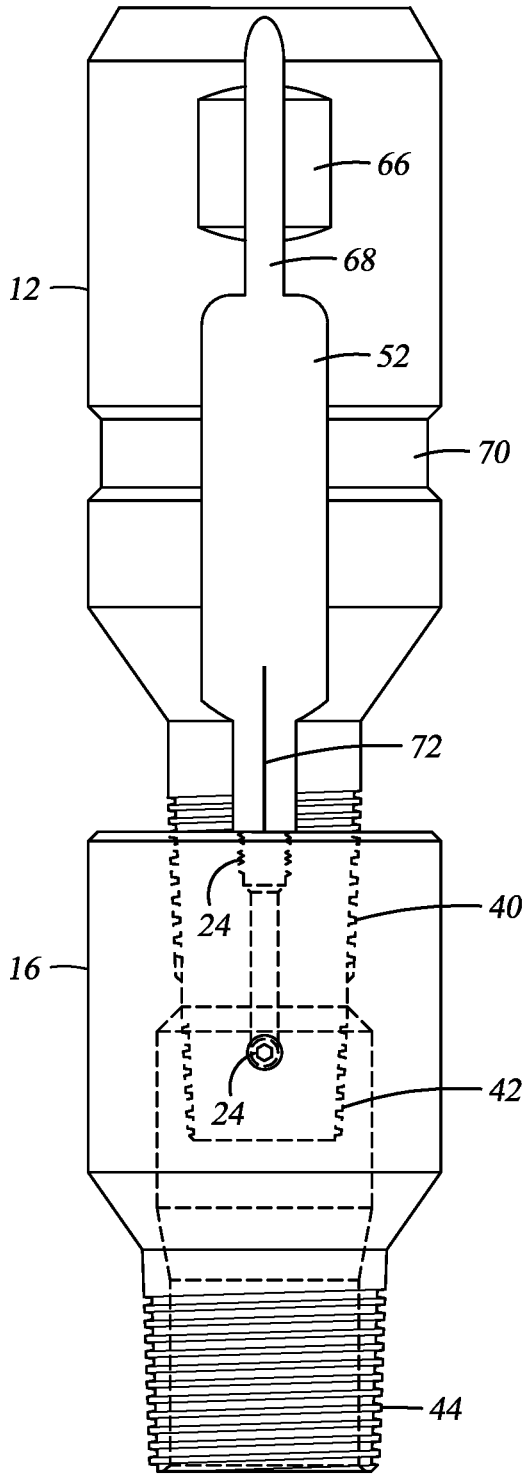
FIG. 5B is a side view of an alternative top sub and an inlet sub.

Referring to FIGS. 5A and 5B, each of the plurality of pockets 52 is formed into the top sub 12. For example, the plurality of inlet ports 24 is first machined in the inlet sub 16. The connection 40 between the top sub 12 and the inlet sub 16 is then made-up using wrench flats 66. A line 72, aligned with each plurality of inlet ports 24, is marked on the top sub 12. Then, the connection 44 is broken, and the pockets 52 are machined along each line 72.

The embodiment of FIG. 5B differs from the embodiment of FIG. 5A in that a plurality of longitudinal grooves 68 optionally extend from a corresponding one of the plurality of pockets 52 to a top surface of the top sub 12. The longitudinal grooves may improve the flow of the first fluid to the check valves 22 and reduce the risk debris plugging the area around the bypass adapter 12. Also, a circumferential groove 70 optionally extends across all of the plurality of pockets 52 at the point where the tops of the check valve 22 fits. The circumferential groove 70 connects all three pockets 52 to generate flow turbulence and prevent debris from settling or scale deposits from forming.

In embodiments where the plurality of check valves 22 are alternatively connected to the exit ports 30 below the bottom sub 20, the plurality of check valves 22 may similarly be located in pockets formed into the bottom sub of the bypass adapter. This configuration may be achieved by increasing the outside diameter tubular body of the bottom sub to 5.5 Inches, threading the exit ports 30 to ½" NPT, extending the length of the section below the exit ports 30 by 6 Inches, and positioning a deflector collar below the check valves 22. This embodiment can only be used in casing strings with an internal diameter larger than 5.5 Inches.

The claimed invention is susceptible to various modifications and alternative forms, specific embodiments thereof are shown by way of example in the drawings and description. It should be understood, however, that the drawings and detailed description thereto are not intended to limit the claims to the particular form disclosed, but on the contrary, the intention is to cover all modifications, equivalents, and alternatives falling within the scope of the claims.

What is claimed is:

1. A bypass adapter for use with a production tubing positioned in a casing string, the bypass adapter comprising:

a top sub including a tubular body connectable to the production tubing;

an inlet sub including a tubular body connectable to the top sub, an inner bore, an outer surface, and a plurality of injection ports extending between the inner bore below a connection to the top sub and the outer surface;

a packer tool connectable to the inlet sub, the packer tool including an inner bore, and a packer element capable of sealing against the casing string;

a bottom sub including a tubular body connectable to the packer tool, an inner bore, a seal located in the inner bore, an outer surface, and a plurality of exit ports extending between the inner bore above the seal and the outer surface;

a plurality of check valves, each of the plurality of check valves being capable of controlling the flow of the first fluid through a corresponding one of the plurality of injection ports of the inlet sub, or through a corresponding one of the plurality of exit ports of the bottom sub; and an inner mandrel connectable to the top sub, the inner mandrel being sized to be positioned in the inner bore of the packer tool, and in the inner bore of the bottom sub in engagement with the seal of the bottom sub;

wherein a first fluid can flow between the production tubing and the casing string, through the plurality of injection ports of the inlet sub, in a space located outside the inner mandrel and inside the inner bore of the packer tool, and through the plurality of exit ports in the bottom sub, and wherein a second fluid can flow inside the inner mandrel and into the production tubing.

2. The bypass adapter of claim 1, wherein an inner bore of the inner mandrel is essentially flush with a lower portion of an inner bore of the top sub whereby downhole tools can be run through the inner bore of the inner mandrel and the inner bore of the top sub.

3. The bypass adapter of claim 1, wherein the space located outside the inner mandrel and inside the packer tool has an annular cross-section with a flow area at least equal to half of the flow area of the inner mandrel.

4. The bypass adapter of claim 1, wherein each of the plurality of check valves is positioned in a corresponding one of a plurality of pockets, each of the plurality of pockets being formed into the top sub or the bottom sub.

5. The bypass adapter of claim 4, further comprising:

a plurality of longitudinal grooves, each of the plurality of longitudinal grooves extending from a corresponding one of the plurality of pockets to an end surface of the top sub; and a circumferential groove extending across all of the plurality of pockets.

6. A bypass adapter for use with a production tubing positioned in a casing string, the bypass adapter comprising:

an outer assembly comprising:

an inlet sub including a tubular body, an inner bore, an outer surface, and a plurality of injection ports extending between the inner bore below a coupling to a top sub and the outer surface;

a packer tool coupled to the inlet sub, the packer tool including an inner bore, and a packer element capable of sealing against the casing string;

a bottom sub including a tubular body coupled to the packer tool, an inner bore, a seal located in the inner bore, an outer surface, and a plurality of exit ports extending between the inner bore above the seal and the outer surface;

an inner assembly coupled to the outer assembly, the inner assembly comprising:

the top sub, wherein the top sub includes a tubular body connectable to the production tubing;

an inner mandrel coupled to the top sub, the inner mandrel being sized to be positioned in the inner bore of the packer tool, and in the inner bore of the bottom sub in engagement with the seal of the bottom sub; and a plurality of check valves, each of the plurality of check valves being capable of controlling the flow of the first fluid through a corresponding one of the plurality of injection ports of the inlet sub, or through a corresponding one of the plurality of exit ports of the bottom sub, wherein a first fluid can flow between the production tubing and the casing string, through the plurality of injection ports of the inlet sub, in a space located outside the inner mandrel and inside the inner bore of the packer tool, and through the plurality of exit ports in the bottom sub, and wherein a second fluid can flow inside the inner mandrel and into the production tubing.

7. The bypass adapter of claim 6, wherein an inner bore of the inner mandrel is essentially flush with a lower portion of an inner bore of the top sub whereby downhole tools can be run through the inner bore of the inner mandrel and the inner bore of the top sub.

8. The bypass adapter of claim 6, wherein the space located outside the inner mandrel and inside the packer tool has an annular cross-section with a flow area at least equal to half of the flow area of the inner mandrel.

9. The bypass adapter of claim 6, wherein each of the plurality of check valves is positioned in a corresponding one of a plurality of pockets, each of the plurality of pockets being formed into the top sub or the bottom sub.

10. The bypass adapter of claim 9, further comprising:

a plurality of longitudinal grooves, each of the plurality of longitudinal grooves extending from a corresponding one of the plurality of pockets to an end surface of the top sub; and a circumferential groove extending across all of the plurality of pockets.

11. A bypass adapter for use with a packer tool on a production tubing positioned in a casing string, the bypass adapter comprising:

a top sub including a tubular body connectable to the production tubing;

an inlet sub including a tubular body coupled to the top sub, an inner bore, an outer surface, and a plurality of injection ports extending between the inner bore below a coupling to the top sub and the outer surface, wherein the inlet sub is connectable to the packer tool;

a bottom sub including a tubular body connectable to the packer tool, an inner bore, a seal located in the inner bore, an outer surface, and a plurality of exit ports extending between the inner bore above the seal and the outer surface;

a plurality of check valves, each of the plurality of check valves being capable of controlling the flow of the first fluid through a corresponding one of the plurality of injection ports of the inlet sub, or through a corresponding one of the plurality of exit ports of the bottom sub; and an inner mandrel coupled to the top sub, the inner mandrel being sized to be positioned in the inner bore of the packer tool, and in the inner bore of the bottom sub in engagement with the seal of the bottom sub, wherein a first fluid can flow between the production tubing and the casing string, through the plurality of injection ports of the inlet sub, in a space located outside the inner mandrel and inside the packer tool, and through the plurality of exit ports in the bottom sub, and wherein a second fluid can flow inside the inner mandrel and into the production tubing.

12. The bypass adapter of claim 11, wherein an inner bore of the inner mandrel is essentially flush with a lower portion of an inner bore of the top sub whereby downhole tools can be run through the inner bore of the inner mandrel and the inner bore of the top sub.

13. The bypass adapter of claim 11, wherein the space located outside the inner mandrel and inside the packer tool has an annular cross-section with a flow area at least equal to half of the flow area of the inner mandrel.

14. The bypass adapter of claim 11, wherein each of the plurality of check valves is positioned in a corresponding one of a plurality of pockets, each of the plurality of pockets being formed into the top sub or the bottom sub.

15. The bypass adapter of claim 14, further comprising:

a plurality of longitudinal grooves, each of the plurality of longitudinal grooves extending from a corresponding one of the plurality of pockets to an end surface of the top sub; and a circumferential groove extending across all of the plurality of pockets.

* * * * *